US006059580A

United States Patent [19]

Konno et al.

[11] Patent Number: 6,059,580

[45] Date of Patent: May 9, 2000

[54] SOCKET CONNECTOR WITH LATERALLY INSERTED CONTACTS

[75] Inventors: Takeshi Konno; Shuichi Sasajima, both of Ibaraki-ken, Japan

[73] Assignee: Mitsumi Electric Co., Ltd., Japan

[21] Appl. No.: 09/181,894

[22] Filed: Oct. 29, 1998

[30] Foreign Application Priority Data

Oct. 30, 1997 [JP] Japan ..... 9-314295

[51] Int. Cl.[7] ..... H01R 12/00

[52] U.S. Cl. ..... 439/74

[58] Field of Search ..... 439/74, 660

[56] References Cited

U.S. PATENT DOCUMENTS 5,192,232 3/1993 Lenz et al. ..... 439/660
5,921,787 7/1999 Pope et al. ..... 439/74

FOREIGN PATENT DOCUMENTS 4-233180 8/1992 Japan .

*Primary Examiner*—Neil Abrams
*Attorney, Agent, or Firm*—Morrison Law Firm

[57] ABSTRACT

A connector mold (4) of a connector socket (1) includes pairs of contact holding chambers (7U,7L) facing each other along a direction perpendicular to a length of the connector socket. Contact insertion openings in opposite sides of the pairs of contact holding chambers permit the insertion of contacts (8U,8L) from opposed sides into the contact holding chambers. The opposite-side installations of the contacts permits pre-installation final forming of the contacts, including an "L"-shaped external connection terminal (8*b*) for external connection of the connector to a circuit board before the contacts are inserted into the mold. Base attachment grooves (10U,10L) in the inner walls of the contact holding chambers guide the insertion of the contacts into their respective contact holding chambers, and fix the contacts in place after insertion. A shield plate (9) is used to prevent electrostatic fingertip charge from reaching the contacts.

1 Claim, 4 Drawing Sheets

SOCKET CONNECTOR WITH LATERALLY INSERTED CONTACTS

BACKGROUND OF THE INVENTION

The present invention relates to an electrical connector. More specifically, the present invention relates to a connector socket used in conjunction with a connector plug.

Referring to FIG. 5, there is shown a car stereo. A well-known method for preventing car stereos from being stolen from a parked car involves a front panel Y that is detachable from a main stereo unit X. When the car is parked, front panel Y, on which buttons and the like are mounted, is removed and carried.

Referring to the dotted lines with double dashes in FIG. 5, a removable hinge is attached to one side of main stereo unit X, which is formed longer horizontally than vertically. Referring to FIG. 6, a connector plug P and a connector socket S are disposed on front panel Y and main stereo unit X in order to provide electrical contact between main stereo unit X and front panel Y.

A connector socket S used in this manner includes a connector mold A that is longer horizontally than vertically. A horizontal plug insertion opening C is formed on the surface of connector mold A to receive a plug section B of connector plug P, which is attached to the back surface of front panel Y.

A plurality of connector pairs D1, D2 is disposed within connector mold A in a symmetric arrangement relative to plug insertion opening C. Connectors D1, D2 include pressure-contact ends d1, which are able to come into contact with plug contacts b of plug section B.

Connector mold A is open on the side facing main stereo unit X, and these contacts are mounted in connector mold A from the back side of connector mold A. Positioning projections are formed on attachment bases d2 and are fixed to attachment grooves E1, E2, which are disposed from front to back in connector mold A. Pressure-contact ends d1, which are continuous with U-shaped deformation absorbers d3, are projected inside plug insertion opening C.

In conventional contacts D1, D2, external connection terminals d4 are bent vertically at right angles after attachment base d2 is attached to attachment grooves E1, E2. External connection terminals d4 are then soldered in main stereo unit X to the printed circuit substrate or the like to which connector mold A is fixed.

However, when external connection terminals d4 of contacts D1, D2 are processed in the final step as described here, it is not possible to accurately bend external connection terminals d4 at right angles. This prevents external connection terminals d4 from being disposed snugly against the surface of the printed circuit substrate upon which connector socket S is mounted. This can result in bad solder joints doing the solder-dipping step.

Stated another way, bending external connection terminals d4 at right angles means performing the bending operation along the back surface of connector mold A. External connection terminals d4 are not bend at precise right angles due to factors such as the springing back of external connection terminals d4. Thus, external connection terminals d4 end up elevated from the conductor layer of the printed circuit substrate surface, thus preventing reliable solder connections.

OBJECTS AND SUMMARY OF THE INVENTION

The object of the present invention is to provide a connector socket which overcomes the problems of the conventional connector socket described above.

It is a further object of the invention to provide a connector socket that includes a structure that allows the external connection terminals of the contacts to be accurately formed.

In order to achieve the objects described above, the present invention proposes a connector socket that includes a long, thin connector mold having a surface on which is formed a plug insertion opening for receiving a plug section of a long, thin connector plug. A plurality of pairs of contacts are mounted inside the connector mold facing each other along a direction perpendicular to the length of the connector mold. The contacts are held in contact holding chambers. Base attachment grooves are formed on an inner wall surface of the contact holding chambers to fix the base of the contacts. An "L"-shaped external connection terminal is bent beforehand at the base of the contacts.

In the description of the preferred embodiments of the present invention presented below, there is also described a structure in which the contact holding chambers are open to opposite sides of the connector mold. The contacts are inserted from these open sections into corresponding contact holding chambers guided by the base attachment grooves.

Briefly stated, the present invention provides a connector mold of a connector socket includes pairs of contact holding chambers facing each other along a direction perpendicular to a length of the connector socket. Contact insertion openings in opposite sides of the pairs of contact holding chambers permit the insertion of contacts from opposed sides into the contact holding chambers. The opposite-side installation of the contacts permits pre-installation final forming of the contacts, including an "L"-shaped external connection terminal for external connection of the connector to a circuit board. Base attachment grooves in the inner walls of the contact holding chambers guide the insertion of the contacts into their respective contact holding chambers, and fix the contacts in place after insertion.

According to an embodiment of the invention, there is provided a connector socket comprising: a connector mold, the connector mold having a surface on which is formed a plug insertion opening for receiving a plug section of a connector plug, at least first and second contact holding chambers in the connector mold, at least one pair of contacts in the at least first and second contact holding chambers, the at least one pair of contacts facing each other along a direction perpendicular to the length of the connector mold, base attachment grooves on inner wall surfaces of the contact holding chambers, the base attachment grooves including means for retaining a base of the contacts, an "L"-shaped external connection terminal at a base of each of the at least one pair of contacts, and the "L"-shaped external connection terminals are bent before the at least one pair of contacts are installed in the contact holding chambers.

According to a feature of the invention, there is provided a connector socket comprising: a connector mold, at least first and second contact holding chambers in opposed first and second sides of the connector mold, a first base attachment groove in the first contact holding chamber, a second base attachment groove in the second contact holding chamber, the first and second base attachment grooves being substantially collinear, at least first and second contacts, the at least first and second contacts each including a base enlargement, a first opening in the first side permitting the base enlargement of the first contact to be fitted along the first base attachment groove for installing the first contact in the first contact holding chamber, a second opening in the second side permitting the base enlargement of the second contact to be fitted along the second base attachment groove for installing the second contact in the second contact holding chamber, a first "L"-shaped external connection terminal at an external end of the first contact; the first "L"-shaped external connection terminal being bendable into its final shape before installation of the first contact, a second "L"-shaped external connection terminal at an external end of the second contact, and the second "L"-shaped external connection terminal being bendable into its final shape before installation of the second contact.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Referring to FIG. 1 through FIG. 4, the following is a detailed description of the embodiments of the present invention.

The connector socket of the embodiment shown in the figures has a structure suited for a front panel Y that is attached to main stereo unit X via a bottom hinge.

Figure 1:
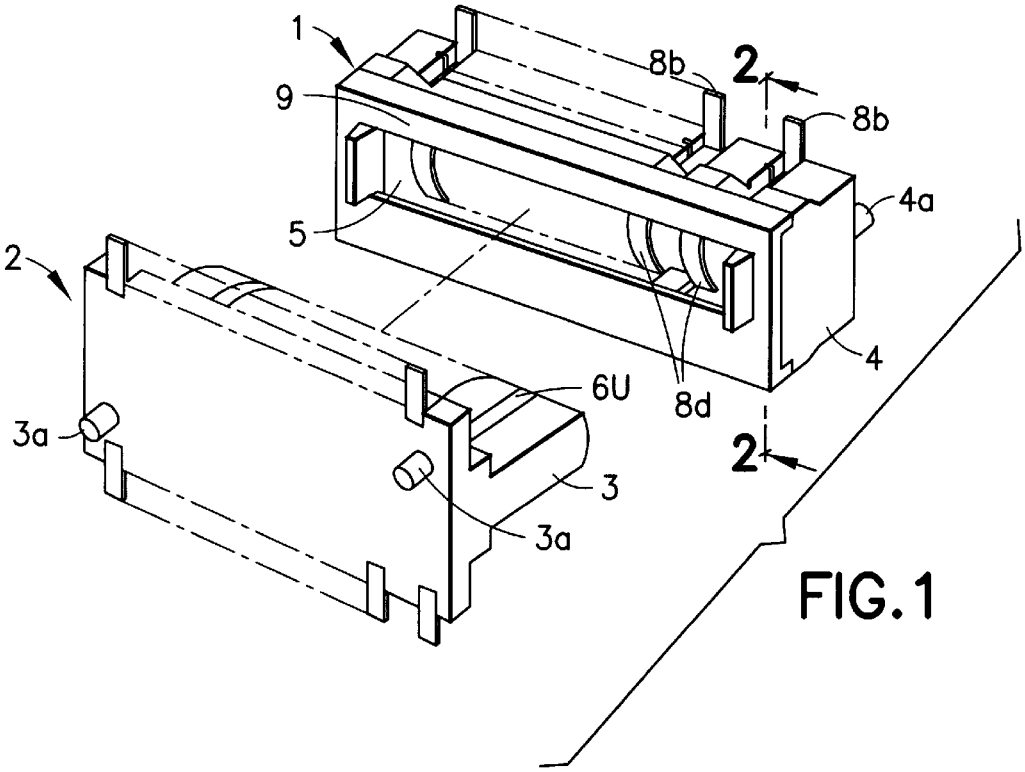
FIG. 1 is a perspective drawing showing the relationship between the connector socket and the connector plug.
Figure 2:
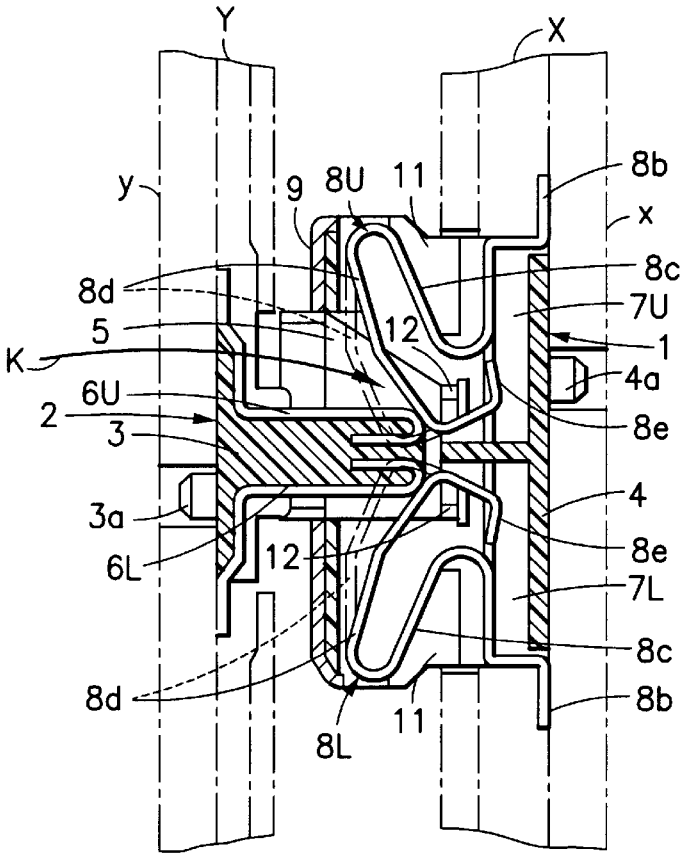
FIG. 2 is a cross-section drawing along line 2—2 in FIG. 1 showing the relationship between the connector socket and the connector plug.

Referring to FIG. 1 and FIG. 2, a connector socket 1 according to the present invention is fixed to the front surface of main stereo unit X of a car stereo by a removable bottom hinge (not shown). A connector plug 2 connected to connector socket 1 is fixed to a back surface of a front panel Y of this car stereo.

A plug section 3 of connector plug 2 includes a positioning pin 3*a* to provide positioning relative to a printed circuit substrate y. Plug section 3 is inserted along an engagement path K into a plug insertion opening 5, which is formed on the surface of a connector mold 4, to be described later, of connector socket 1.

Referring to FIG. 2, plug section 3 extends in a direction perpendicular to the plane of the page. Multiple pairs of plug contacts 6U, 6L are exposed on the upper and lower surfaces of the front end of plug section 3. Referring to FIG. 2, plug contacts 6U, 6L are arranged in rows perpendicular to the plane of page.

Connector mold 4, which is molded from an insulating resin, is fixed to a printed circuit substrate x of main stereo unit X and is positioned via a positioning pin 4*a*. Referring to FIG. 2, pairs of contact holding chambers 7U, 7L are formed side-by-side as upper and lower rows extending perpendicular to the plane of the page. Multiple pairs of contacts 8U, 8L are placed from above and below connector mold 4 into contact holding chambers 7U, 7L. Contacts 8U, 8L are arranged so that there is symmetry between the upper and lower portions of plug section 3.

A plug insertion opening 5 is formed on the front surface of connector mold 4 to receive plug section 3. Plug insertion opening 5 is formed continuously with contact chambers 7U, 7L. Plug insertion opening 5 is disposed toward the upper section and is positioned asymmetrically relative to contacts 8U, 8L. The reason for this is that when front panel Y has a bottom hinge, engagement path K for plug section 3 forms an arcuate path having a center of rotation below connector mold 4. The asymmetrical positioning of plug insertion opening 5 allows the end of plug section 3 to be inserted without obstruction. Furthermore, by making vertical opening width W of plug insertion opening 5 as small as possible, the insertion of a charged fingertip or foreign objects into plug insertion opening 5 is prevented.

A shield plate 9 is positioned around plug insertion opening 5 to cover the entire front surface of connector mold 4. Thus, when an electrostatically charged fingertip is about to be inserted into plug insertion opening 5, the contact between the fingertip and shield plate 9 causes the static electricity on the fingertip to be grounded via shield plate 9.

Figure 3:
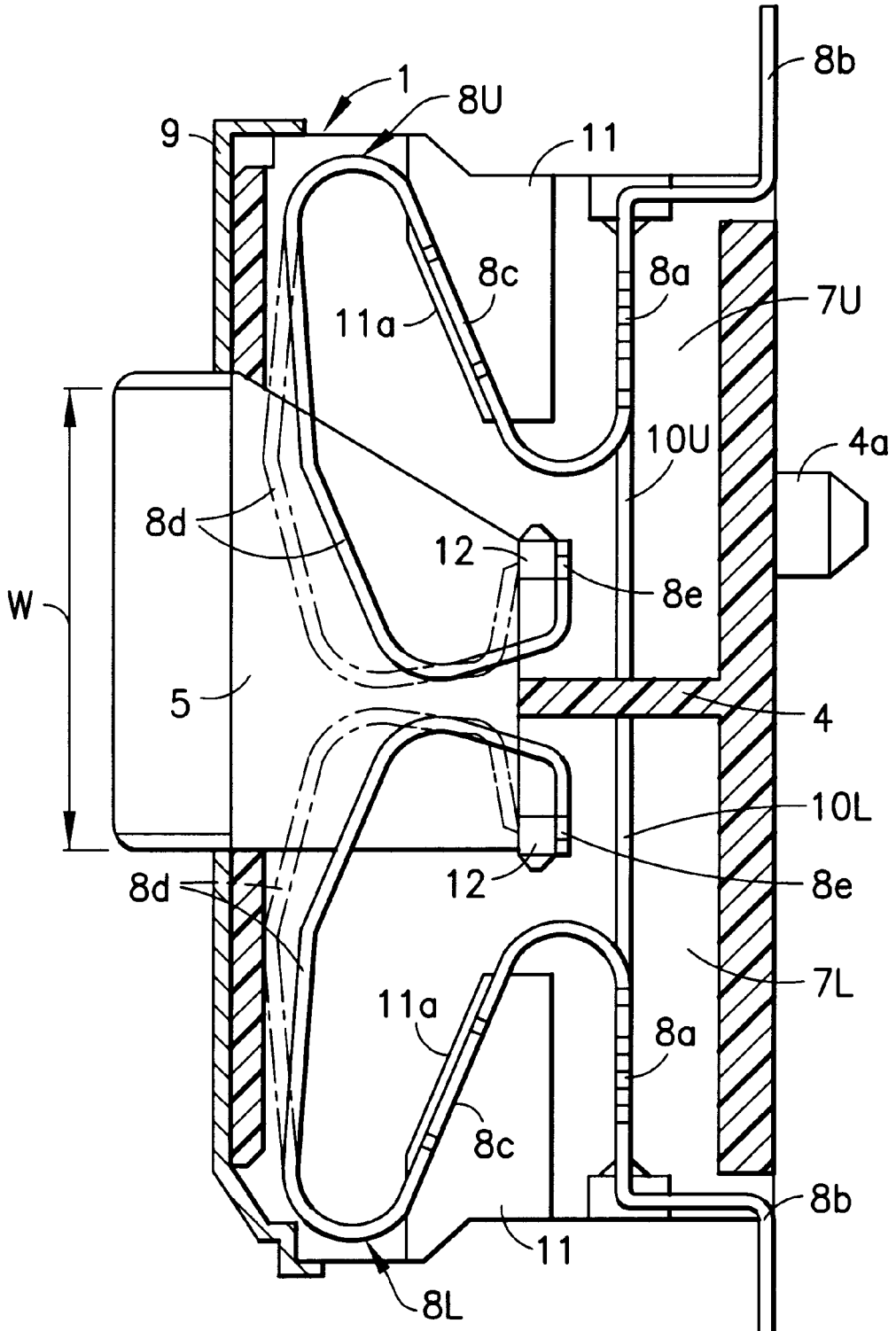
FIG. 3 is an enlarged cross-section drawing of the connector socket.
Figure 4:
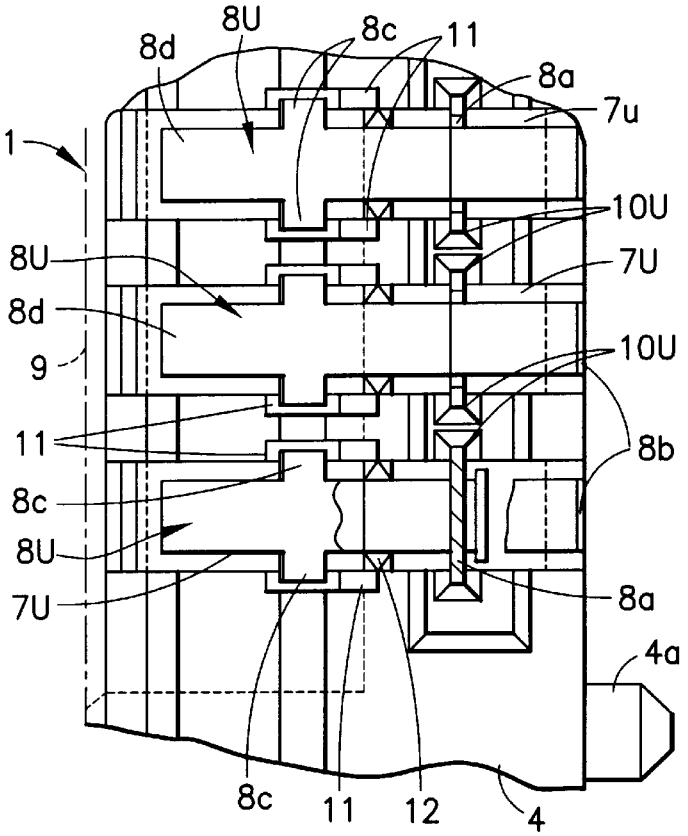
FIG. 4 is an enlarged top-view drawing of the connector socket.
Figure 5:
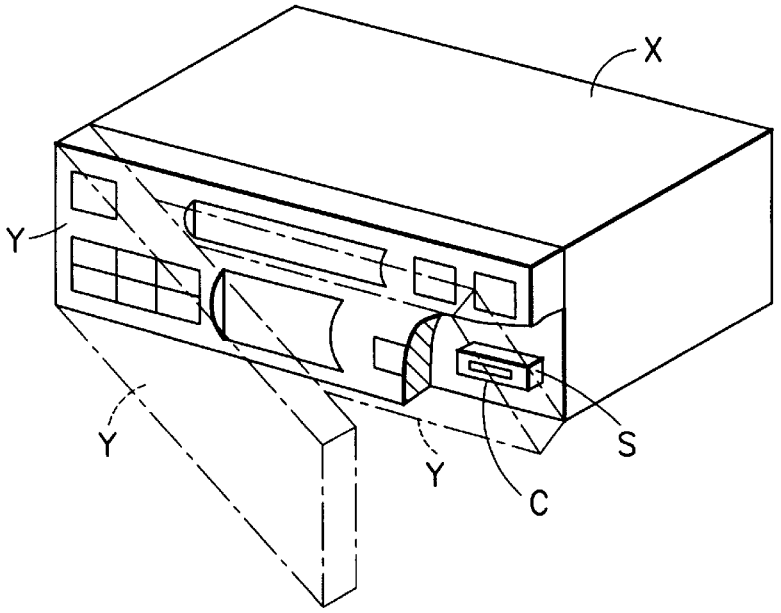
FIG.5 PRIOR ART
FIG. 5 is a perspective drawing of a prior art car stereo with a section cut away.
Figure 6:
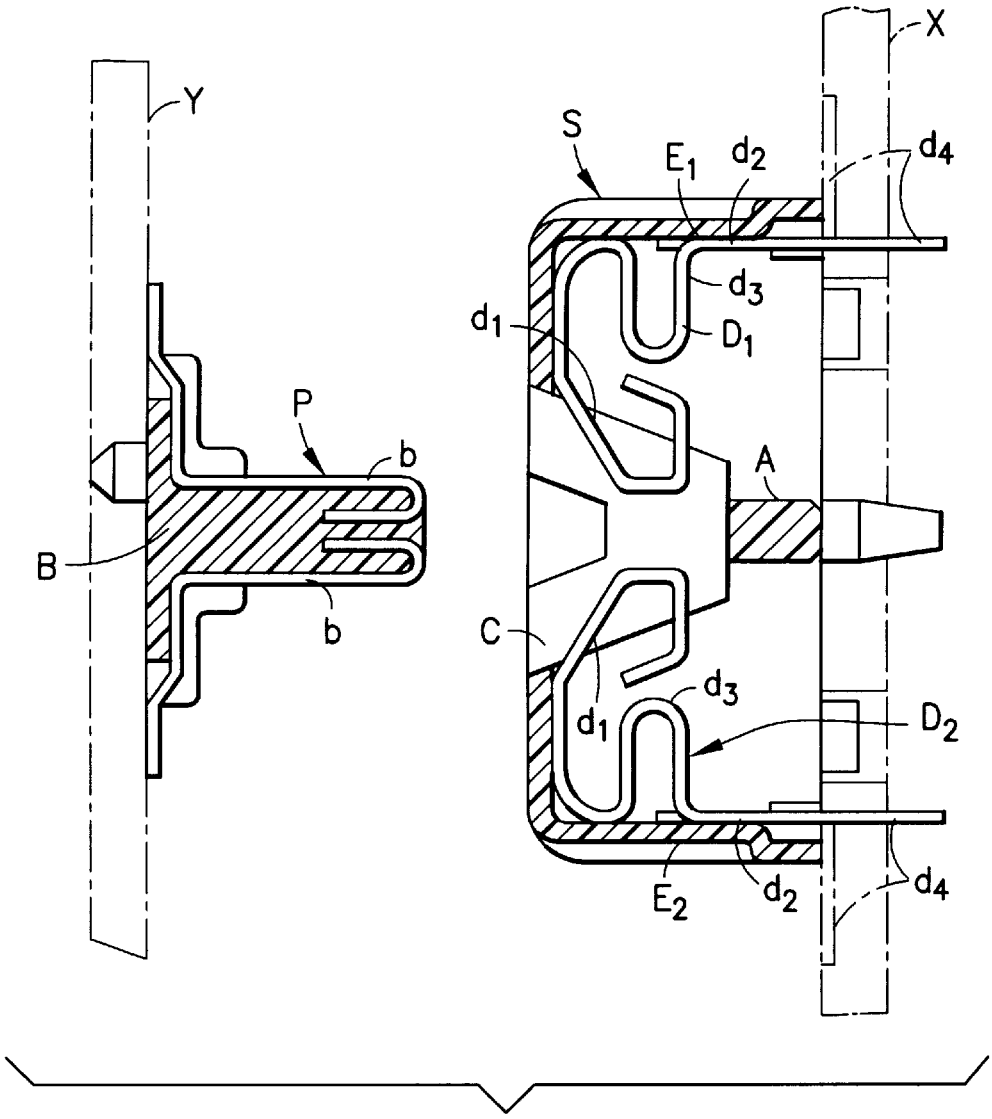
FIG.6 PRIOR ART
FIG. 6 is a perspective drawing showing the relationship between the connector socket and the connector plug in an example from the conventional technology.

Referring to FIG. 3 and FIG. 4, the manner in which contacts 8U, 8L are attached is shown. Base enlargements 8*a* are formed as widened sections of contacts 8U, 8L. Base attachment grooves 10U, 10L are formed vertically on the inner wall surfaces of contact holding chambers 7U, 7L, which hold contacts 8U, 8L. Base attachment grooves 10U, 10L are formed so that base enlargement 8*a* of contacts 8U, 8L can be pressed into base attachment grooves 10U, 10L. Stopping projections formed on base enlargements 8*a* allow contacts 8U, 8L to be fixed inside contact holding chambers 7U, 7L.

Contacts 8U, 8L include L-shaped external connection terminals 8*b*, which are continuous with base enlargement 8*a*. Before being attached to connector mold 4, external connection terminals 8*b* are formed with right angles and are parallel to the back surface of connector mold 4. A pressing operation results in a bend on one side of base enlargement 8*a*, thus providing a precise bend for external connection terminal 8*b*.

Contacts 8U, 8L are formed with center sections that are bent away from base enlargements 8*a*. Center section stoppers 8*c*, which are disposed at these center sections, are positioned within center section engagement openings 11. Center section engagement openings 11 are formed from above and below on the inner walls of contact holding chambers 7U, 7L. An engagement section 11*a* on center section engagement opening 11 prevents center section stopper 8*c* from moving forward (to the left in FIG. 3).

A bend resembling the bend in a hairpin is formed near the center sections of contacts 8U, 8L. An arcuate pressure-contact end 8*d* is exposed in plug insertion opening 5. Pressure-contact end 8*d* can be elastically deformed by plug section 3 of connector plug 2. An end projection 8*e* is formed at the end of pressure-contact end 8*d*. Small projections 12 that can engage with end projection 8*e* are formed facing each other inside each of contact holding chambers 7U, 7L. This provides stable positioning of pressure-contact ends 8*d*.

Connector socket 1 according to the embodiment shown in the drawings is configured as described above and can be assembled according to the steps described below.

A bending operation is performed by using a press on contacts 8U, 8L. External connection terminals 8*b* at one end of base enlargements 8*a* are bent. Base enlargements 8*a* of contacts 8U, 8L are guided from opposite sides of connector mold 4 along base attachment grooves 10U, 10L to position contacts 8U, 8L in contact holding chambers 7U, 7L of connector mold 4. Referring to FIG. 3, base enlargements 8*a* of contracts 8U, 8L are pressed into and fixed in base attachment grooves 10U, 10L so that pressure-contact ends 8*d* of contacts 8U, 8L are positioned as indicated by the dotted lines in FIG. 3.

Pressure-contact ends 8*d* of contacts 8U, 8L are deformed slightly to permit end projection 8*e* of pressure-contact end 8*d* to pass behind corresponding projection 12. Elastic deformation urges pressure-contact end 8*d* to its position behind projection 12. Thereafter, projection 12 stops end projection 8*e* of pressure-contact end 8*d* from moving outward. Thus, the connector can be assembled in a manner that prevents pressure-contact end 8*d* from moving too far outward.

Also, assembly of contacts 8U, 8L of connector mold 4 does not involve the application of external force on external connection terminals 8*b* of contacts 8U, 8L. Thus, external connection terminals 8*b* can be bent accurately and kept parallel to the surface of printed circuit substrate x to which they will be attached.

In a car stereo installation, when plug section 3 is inserted into plug insertion opening 5, plug section 3 pushes apart pressure-contact ends 8*d* of contacts 8U, 8L, as indicated by the solid lines in FIG. 2. End projections 8*e* of pressure-contact ends 8*d* move away from projections 12. Contacts 8U, 8L, which correspond to plug contacts 6U, 6L of plug section 3 come into contact with pressure-contact end 8*d*, thus providing an electrical connection between main stereo unit Y and plug 2.

When connector plug 2 in the state shown in FIG. 2 is then pulled out, pressure-contact ends 8*d* are urged toward plug insertion opening 5 due to the friction of pressure-contact ends 8*d* of contacts 8U, 8L on plug contacts 6U, 6L. Center stoppers 8*c* of contacts 8U, 8L come into contact with and are restricted by engagement surface 11*a* of center section engagement opening 11. Thus excessive displacement of the center section is prevented and end projection 8*e* is reliably prevented from disengaging from projection 12 due to excessive deformation of pressure-contact end 8*d*.

In connector socket 1 according to the embodiment shown in the drawings, shield plate 9 is positioned around plug insertion opening 5 to cover the entire front surface of connector mold 4. Thus, when an electrostatically charged fingertip is about to be inserted into plug insertion opening 5, contact between the fingertip and shield plate 9 grounds the electrostatic charge at the fingertip via shield plate 9. Thus, even if the fingertip were to come into contact with pressure-contact end 8*d* of contacts 8U, 8L, the electrostatic charge is prevented from going through pressure-contact end 8*d* and flowing into the internal circuitry connected to contacts 8U, 8L.

As the description above makes clear, the present invention provides external connection terminals that have been bent at an angle beforehand at the contact base. Thus, the external connection terminals can be bent accurately and bad solder joints with the printed circuit substrate can be prevented.

In the invention, when the contacts are being inserted in the contact holding chambers, external force can be applied to the base of the contact for insertion without having the external connection terminal affected by the external force, thus allowing the bent state of the external connection terminal to be maintained and providing a reliably assembled product.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A connector socket comprising:

a connector mold;

said connector mold having a surface on which is formed a plug insertion opening for receiving a plug section of a connector plug;

at least first and second contact holding chambers in said connector mold;

at least one pair of contacts in said at least first and second contact holding chambers;

said at least one pair of contacts facing each other along a direction perpendicular to the length of said connector mold;

base attachment grooves on inner wall surfaces of said contact holding chambers;

said base attachment grooves including means for retaining a base of said contacts;

an "L"-shaped external connection terminal at a base of each of said at least one pair of contacts; and said "L"-shaped external connection terminals are bent before said at least one pair of contacts are installed in said contact holding chambers, wherein said contact holding chambers are opened to opposite sides of said connector mold; and said contacts are insertable from opposite sides into said open sections into corresponding contact holding chambers by being guided by said base attachment grooves.

* * * * *